US005287157A

United States Patent [19]

Miyazato et al.

[11] Patent Number: 5,287,157

[45] Date of Patent: Feb. 15, 1994

[54] SHEET STRAIGHTENING DEVICE

[75] Inventors: Kazuhiko Miyazato; Yoshio Shoji; Koichi Makiyama; Kazuo Asaka; Kengo Taneda; Yoshiyuki Takaishi; Takahiko Kobayashi, all of Kanagawa, Japan

[73] Assignee: Fuji Xerox Co., Ltd., Tokyo, Japan

[21] Appl. No.: 879,278

[22] Filed: May 7, 1992

[51] Int. Cl.[5] ..... G03G 15/00

[52] U.S. Cl. ..... 355/309; 162/197; 271/297; 271/305; 355/285

[58] Field of Search ..... 355/309, 289–290, 355/285, 282; 162/270, 271; 271/297, 305; 219/216

[56] References Cited

U.S. PATENT DOCUMENTS

| | | | |
|---|---|---|---|
| 4,505,695 | 3/1985 | Billings | 162/271 X |
| 5,066,984 | 11/1991 | Coombs | 355/309 |
| 5,084,731 | 1/1992 | Baruch | 355/208 |
| 5,104,117 | 4/1992 | McCormick et al. | 271/297 |

FOREIGN PATENT DOCUMENTS

| | | | |
|---|---|---|---|
| 59-167450 | 9/1984 | Japan . | |
| 0070270 | 3/1988 | Japan | 355/311 |
| 2-97352 | 8/1990 | Japan . | |
| 0050583 | 3/1991 | Japan | 355/311 |

*Primary Examiner*—A. T. Grimley
*Assistant Examiner*—T. A. Dang
*Attorney, Agent, or Firm*—Finnegan, Henderson Farabow, Garrett & Dunner

[57] ABSTRACT

A sheet straightening unit including a device for pushing a depressing roll against an endless belt, so that a curled sheet is straightened when passing between the endless belt and the depressing roll pushed against the latter. The depressing roll is provided with an amount-of-depression adjusting mechanism which includes a cam member and a cam follower member engaged with the former, in such a manner that the cam member is turned according to the kind and image density of the curled sheet, thereby to most suitably determine the extent to which depressing roll is pushed against the endless belt.

22 Claims, 7 Drawing Sheets

FIG. 12

SELECTING CONDITION OF DEPRESSION

| COPY PAPER / AMOUNT OF DEPRESSION | OHP SHEET | | PAPER | | | | | |
|---|---|---|---|---|---|---|---|---|
| | | | STANDARD | | | THICK | | |
| | | | | COLOR (2~4 COLORS) | | | COLOR (2~4 COLORS) | |
| | B/W | COLOR | B/W OR 1 COLOR (Y, M, C) | IMAGE DENSITY LEVEL 50% OR LESS | IMAGE DENSITY LEVEL MORE THAN 50% | B/W OR 1 COLOR (Y, M, C) | IMAGE DENSITY LEVEL 50% OR LESS | IMAGE DENSITY LEVEL MORE THAN 50% |
| SMALL | ○ | ○ | | | | ○ | ○ | |
| MIDDLE | | | ○ | ○ | | | | ○ |
| HIGH | | | | | ○ | | | |

FLOW CHART

SHEET STRAIGHTENING DEVICE

BACKGROUND OF THE INVENTION

This invention relates to a device for eliminating the curling of a copy which is formed by an image forming device such as an electronic copying machine, and more particularly to a device in which a roll member small in diameter is pushed against an endless belt, to forcibly bend a curled sheet in the direction opposite to the direction of curling, thereby to straighten the sheet (hereinafter referred to as "a sheet straightening device", when applicable).

In forming a copy with an image forming apparatus of electrophotographic system such as an electronic coping machine, a method is employed in which a recording sheet bearing a toner image is delivered to a fixing unit, where the toner image is fixed by heat and pressure. The copy thus formed may be greatly curled depending on the density of the toner image formed on the sheet, and the kind and thickness of the latter. If the sheet thus curled is delivered into a sheet discharging tray as it is, sometimes it is jammed being caught in the sheet conveying path. Furthermore, in the case where an after-treatment device such as a sorter is provided beside the sheet discharging section of the image forming apparatus, the curled sheet results in a difficulty that, in the sorter, the number of copies received in the tray is decreased; that is, the copy accommodating capacity of the sorter is decreased. In an automatic both-side copying machine, the curled sheet may cause the following difficulties: That is, when a sheet on one side of which an image has been formed is conveyed for formation of an image on the other side, it may be jammed in the sheet conveying path, or it may be inaccurately delivered into the intermediate tray, thus impeding the formation of the image on the other side of the sheet.

In order to straighten the curled sheet, a method has been proposed in the art in which, as disclosed, for instance, by Japanese Utility Model Application (OPI) No. 97352/1990 (the term "OPI" as used herein means an "unexamined published application"), a curling eliminating device is arranged in a sheet conveying path through which a sheet on one side of which an image has been formed is conveyed to the intermediate tray. In this conventional device, the sheet conveying path is bent greatly, and a metal roller relatively small in diameter and an elastic roller relatively large in diameter are arranged at the bend of the sheet conveying path in such a manner that those rollers abut against each other, so that the sheet is abruptly bent when passing between the two rollers, and is then caused to slide along the curved portion of a guide board. And, two sets of the above-described curling eliminating devices are provided so as to bend a curled sheet in opposite directions, whereby the curled sheet can be straightened on one side of which an image has been formed.

A monochromatic (black and white) copy formed with an ordinary image forming apparatus is relatively low in image density, and therefore the curling of a sheet which is caused when the sheet passes through the fixing unit is, in general, relatively little. Hence, in this case, the curled sheet can be readily straightened with the above-described curling eliminating device. On the other hand, in the case where, as was described above, it is required to set the curling eliminating device between the fixing unit and the sheet discharging tray, it may be rather difficult to do so because the limitation in occupying space of the device. In the case of a color copy high in image density, it is liable to be greatly curled, and the curling cannot be eliminated with the above-described curling eliminating device.

In order to eliminate the curling of such a color copy, a sheet straightening device as disclosed, for instance, by Japanese Patent Application (OPI) No. 167450/1984 may be employed. In this conventional sheet straightening device, a depressing roll is provided for a belt adapted to convey a copy. The depressing roll is pushed against the belt to bend the latter, so that a sheet is forcibly bent when passing between the belt and the depressing roll thus pushed against the latter, thereby to eliminate the curling of the sheet. The depressing roll is so designed that it can be fixed or rotated. That is, the predetermined front end portion of the curled sheet is rubbed with the depressing roll fixed, thereby to eliminate the curling.

In the conventional sheet straightening device, the force of depression applied through the depression roll to the belt is set to a predetermined value. Therefore, if the belt is bent greatly so as to handle a color copy which is liable to be greatly curled, then a black and white copy may be curled in the opposite direction. In the case where the sheet straightening ability is set for a copy low in image density, then the device cannot sufficiently handle a color copy, and cannot satisfactorily eliminate the curling of a sheet depending on the thickness and paper quality of the sheet. In addition to the above-described difficulties, in the case where color images are formed on both sides of a sheet, the following troubles may be involved. That is, if the color images on both sides of the sheet are different in image density, then the sheet is curled in a plurality of directions; that is, the curling of the sheet is not constant in direction. Thus, even if the conventional sheet straightening device is applied to the curled sheet on both sides of which color images have been formed, it is rather difficult to eliminate the curling of the sheet with high efficiency.

SUMMARY OF THE INVENTION

Accordingly, an object of this invention is to eliminate the above-described difficulties accompanying a conventional sheet straightening device. More particularly, an object of the invention is to provide a sheet straightening device simple in construction in which its curling eliminating operation is controlled according to the paper quality and thickness of a recording sheet, or the kind of a copy.

This invention relates to a sheet straightening device in which a curled sheet is straightened by rubbing it in the direction opposite to the direction of the curling. In a sheet straightening device according to the invention, an endless belt driven in the direction of conveyance of a sheet, and a depressing roll which is pushed against the endless belt with a predetermined force of depression are provided, the belt is supported by guide roller means provided at short intervals, and means for adjusting the force of depression used for pushing the depressing roll against the endless belt is provided, so that the curled sheet is forcibly bent when passing between the endless belt and the depressing roll pushed against the endless belt, thus being straightened.

In the sheet straightening device, in order to control the sheet bending action, the force of depression for pushing the depressing roll against the endless belt is determined according to data on the thickness of the sheet or data on the kind of the sheet (ordinary sheet, OHP sheet, etc) or data on the image density of the copy, or the kind of the copy (color, black and white, etc.), or data on one side copy or both side copy.

Furthermore, in the sheet straightening device, the endless belt is made up of a plurality of belt members relatively small in width, which are driven at the same time, and one depressing roll is pushed against the plurality of belt members simultaneously. In addition, in the straightening device, means for adjusting the force of depression used for pushing the depressing roll against the endless belt is made up of a cam member, and angular position adjusting means is provided for the cam member so as to adjust the force of depression in a plurality of steps. Moreover, in the sheet straightening device, the angular position adjusting means for adjusting the force of depression applied to the depressing roll comprises: a solenoid; and an indexing disk having a plurality of pawl members protruded radially outwardly thereof. The pawl members are selectively locked by locking pawl means which is driven by the solenoid, to control the force of depression.

In addition, in the sheet straightening device of the invention, two sheet straightening devices different in the direction of straightening a curved sheet are arranged. The two sheet straightening members are selectively operated according to the direction of curling of the sheet, so that the curled sheet is straightened depending, for instance, on the densities of the images formed on its both sides. The two sheet straightening devices are arranged in series or in parallel with respect to the copy discharging path. The sheet straightening members thus arranged are selectively operated according to the data on the copy outputted by the image forming apparatus body, to straighten the copy. The copy, after being straighten up, is conveyed to the following processing means (such as a sorter).

As was described above, in the sheet straightening device of the invention, the depressing roll is pushed against the endless belt to bend the latter, and the degree of bending the endless belt with the depressing roll is adjustable. Hence, the curling eliminating operation is carried out according to the degree of curling of the sheet. Furthermore, the sheet straightening device of the invention can be readily set between the fixing unit and the sheet discharging rollers in an electronic copying machine and, and therefore it can be applied to an electronic copying machine relatively small in size. In addition, the sheet straightening device of the invention can handle an ordinary black and white copy as well as a color copy, and can be operated according to the thickness and paper quality of a sheet.

BRIEF DESCRIPTION OF THE DRAWINGS

FIG. 12 is an explanatory diagram showing a look up table stored in the control means of the device shown in FIG. 11.

DETAILED DESCRIPTION OF THE PREFERRED EMBODIMENTS

Preferred embodiments of this invention will be described with reference to the accompanying drawings.

Figure 1:
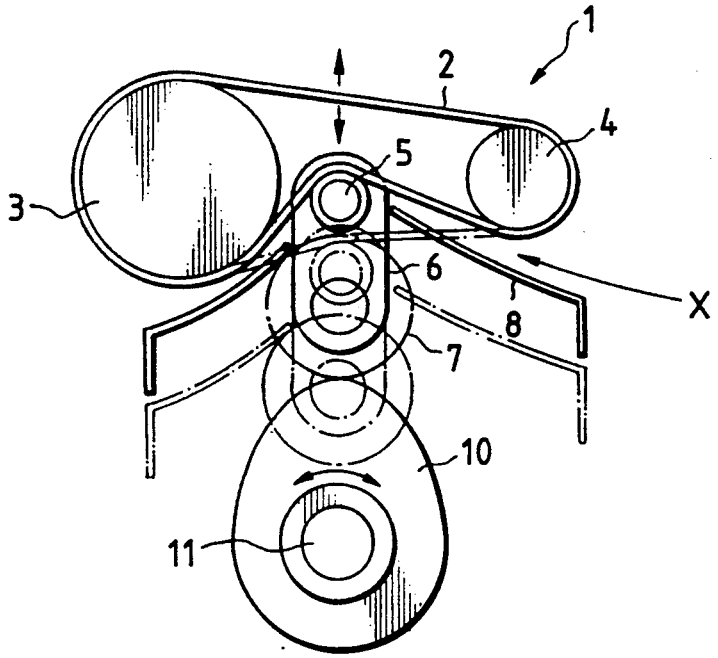
FIG. 1 is a side view showing a sheet straightening unit provided for a sheet straightening device according to this invention.

As shown in FIG. 1, a sheet straightening device 1 employs a method in which an endless belt 2 is bent greatly inwardly with a depressing roll 5 pushed against it, and under this condition a sheet is passed between the belt 2 and the roll 5. The belt 2 is laid over a drive shaft 3 and a support shaft 4 which are positioned with a relatively short distance therebetween. The roll 5 is located between the two shafts 3 and 4 to depress the belt 2 at the middle. The roll 5 is supported by a link member 6. The link member 6 has a cam follower member 7 at the end, in such a manner that the cam follower member 7 is abutted against a depressing mechanism, namely, a cam member 10. The roll 5 is protruded through the top of a substantially inverted-V-shaped cover member 8, so as to lead to the nipping region of the sheet straightening device 1 a sheet which is conveyed in the direction of the arrow X through the gap between the belt 2 and the cover 8, thereby to eliminate the curling of the sheet. In the sheet straightening device 1 thus constructed, the amount of bend of the belt 2 is adjusted as follows: That is, a shaft 11 is rotated to turn the cam member 10 thereby to adjust the amount of protrusion of the roll 5 towards the belt 2; that is, the amount of bend of the belt 2 by the roll 5.

The sheet straightening device 1 will be described in more detail. The device 1 is designed as shown in a perspective view of FIG. 2 and a side view of FIG. 3. The drive shaft 3 is an elongated rotary shaft relatively large in diameter, and the support shaft 4 is also an elongated rotary shaft relatively small in diameter. More specifically, the diameter of the support shaft 4 is about a half (½) of that of the drive shaft 3. A number of endless belts 2 relatively small in width are laid over those shafts 3 and 4 in such a manner that they are in parallel with one another so that they are driven in the same direction at the same time. In the sheet straightening device of the invention, the recording side of the sheet, on which an image is formed, is so set as to confront with the belt 2; that is, the roll 5 pushes the sheet from behind.

The roll 5 adapted to push the sheet against the belt 2 is in the form of a rod relatively small in diameter. More specifically, the diameter of the roll 5 is about a half (½) of that of the support shaft 4. Both end portions of the roll 5 are rotatably supported by the bearing holes 6*a* of link members 6. In addition, auxiliary link members 6*b* are mounted on the roll 5 at predetermined positions, so as to support the middle portion of the roll 5 through their shaft supporting portions having recesses in such a manner that the roll 5 is pushed against the belt 2. The auxiliary link members 6*b* have cam follower members 7, respectively, and cam members 10 are provided for the cam follower members 7, respectively. Each of the cam members functions as follows: As the cam shaft 11 is turned, the cam member is turned to adjust the amount of depression of the roll towards the belt, and accordingly the amount of bend of the belt.

Figure 4:
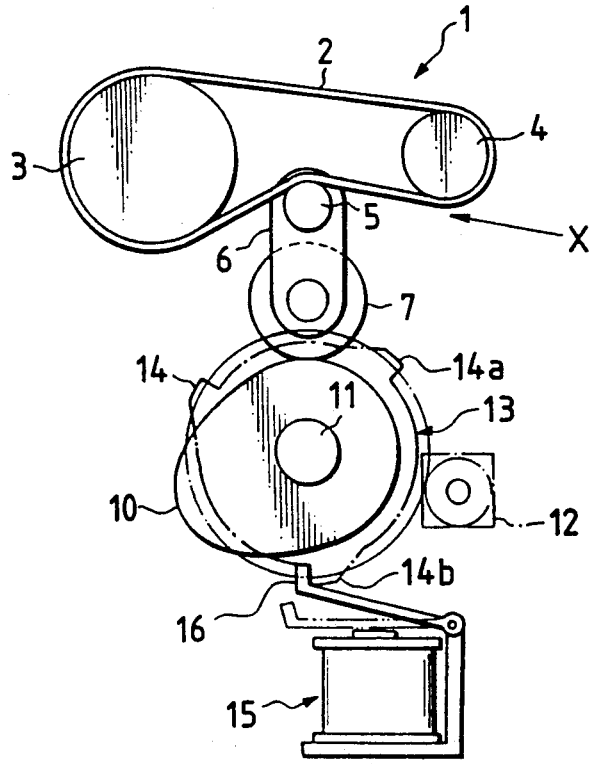
FIG. 4 is an explanatory diagram showing the sheet straightening unit provided with a mechanism for controlling the rotation of a cam member.

In order to adjust the action of eliminating the curling of a sheet by changing the angle of rotation of the cam members 10, means for adjusting the angle of rotation of a cam member as shown in FIG. 4 may be employed. That is, as shown in FIG. 4, an indexing disk 13 with a plurality of pawl members 14, 14*a* and 14*b* is mounted on the cam shaft 11, and locking means comprising a locking pawl 16 operated by a solenoid 15 is provided for the indexing disk 13. The pawl members of the indexing disk 13 are set according to the distance for which the roll 5 depresses the belt, so that the amount of depression of the roll can be set to a desired value with the locking pawl 16 engaged selectively with the pawl members of the indexing disk 13. The cam shaft 11 is turned with an electric motor 12 until the cam member 10 is positioned where a desired amount of depression of the roll 5 is obtained. Thus, the amount of depression of the roll 5 against the belt can be controlled.

The image forming device with the above-described sheet straightening device 1 may have means for inputting data on the paper quality of recording sheets put on a sheet supplying tray or the like to a controller, for instance, through a control panel, or means for utilizing data on the density of a toner image formed on a photosensitive drum, to estimate the state of curling of a recording sheet. In this case, the state of curling of a recording sheet is estimated from the above-described data on paper quality or image density, and an amount of depression of the roll most suitable for eliminating the curling of the sheet is determined, and the cam member is turned until the amount of depression of the roll thus determined is obtained In the sheet straightening device shown in FIG. 4, the indexing disk 13 mounted on the shaft of the cam member has only three pawl members. However, in order to set the amount of depression of the roll more precisely, the number of pawl members should be increased. It goes without saying that the larger the number of pawl members is, the more precisely the amount of depression of the roll can be set.

Figure 2:
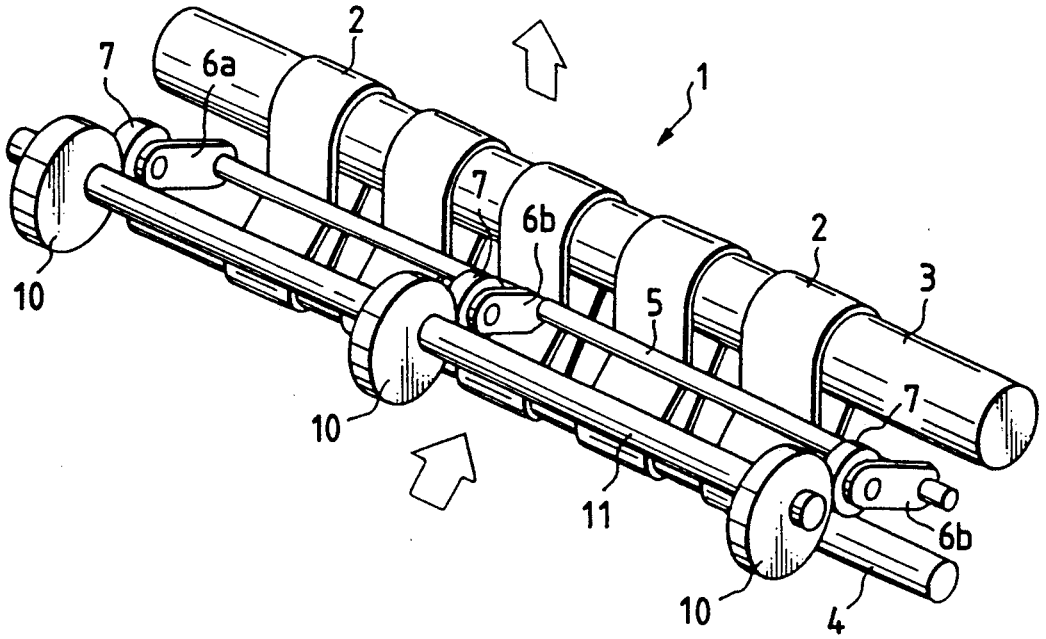
FIG. 2 is a perspective view showing positional relationships between a depressing roll and endless belts in the sheet straightening unit according to the invention.
Figure 3:
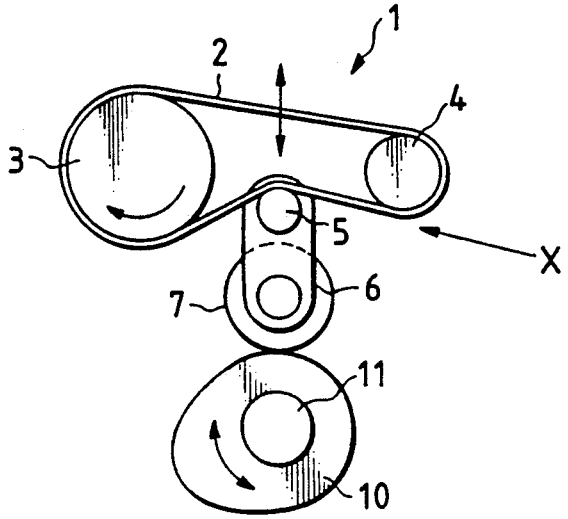
FIG. 3 is a side view of essential components of the sheet straightening unit shown in FIG. 2.
Figure 5:
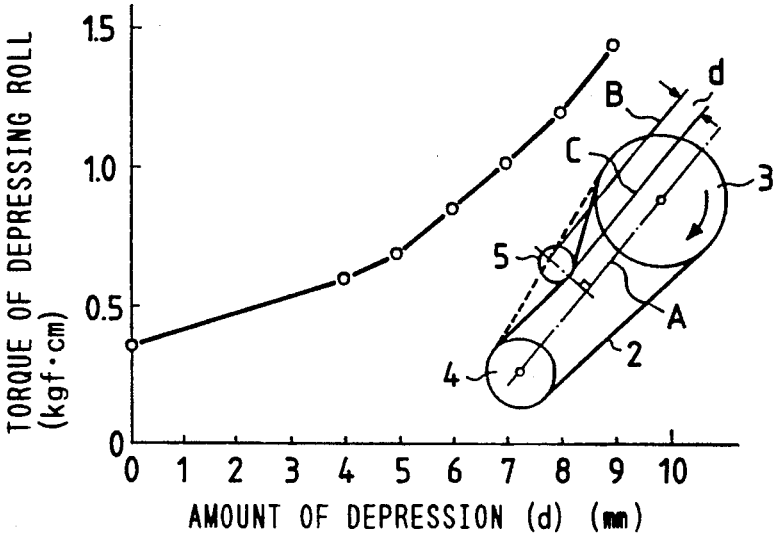
FIG. 5 is a graphical representation indicating relationships between the amounts of depression and torque of the depressing roll.

When, in the sheet straightening device 1 thus constructed, the depressing roll 5 is supported in such a manner that both end portions thereof are engaged with the bearing holes 6*a* of the link members 6 and the middle portion are engaged with the recesses of the auxiliary link members 6*b* as shown in FIG. 2, the torque of the depressing roll 5 is as indicated in FIG. 5. As is seen from a graphical representation of FIG. 5, as the amount of depression of the roll against the belt increases, the torque of the roll is increased. In practice, the degree of curling of the sheet is decreased or eliminated depending on the amount of depression of the roll as follows: In the case where the amount of depression of the roll is small, the roll is rotated relatively lightly, and therefore the sheet is not strongly rubbed by the roll; that is, a relatively weak force is applied to the sheet for decreasing the degree of curling of the sheet. On the other hand, as the amount of depression of the roll increases, the force of rubbing the sheet with the roll is increased, so that the degree of curling of the sheet is decreased more positively. In the graphical representation of FIG. 5, reference character d designates an amount of depression of the roll which is the distance between the straight lines B and C which are drawn as follows: First, the straight line A connecting the centers of the two shafts supporting the endless belt 2, and the straight line B passing through the position where the depressing roll is brought into contact with the belt are drawn in parallel to each other, and the straight line C passing through the position where the roll depresses the belt is drawn in parallel to the straight line B.

Figure 6:
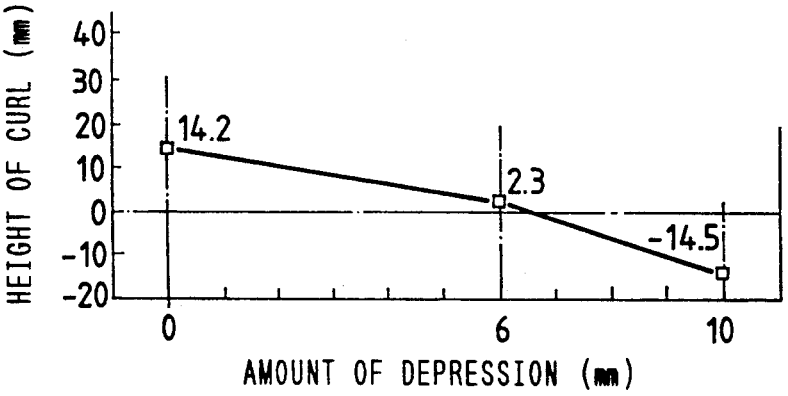
FIG. 6 is a graphical representation for a description of the elimination of the curling of a sheet.

A copy formed by an ordinary electronic copying machine may be as follows: That is, as shown in FIG. 6, in the case where the image density is 10%, the copy is curled as indicated at an amount of depression of 0 mm. It has been found that, when the amount of depression is set to 6 mm, the curling of the same sheet is substantially eliminated, and when the amount of depression is set to 10 mm, the same sheet is curled greatly in the opposite direction. Thus, in the sheet straightening device of the invention, it is necessary to adjust the amount of depression of the roll pushed against the belt according to the height of a curl formed with a sheet. For this purpose, the cam member is effective.

Figure 7:
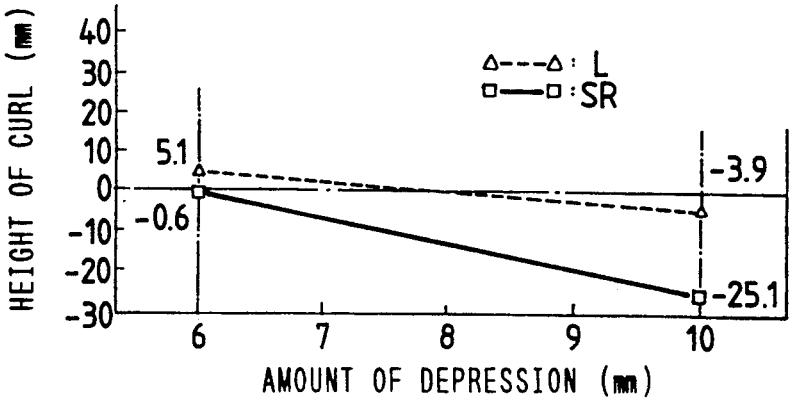
FIG. 7 is a graphical representation for a description of the elimination of the curling of sheets different in thickness.

The state of curling of a sheet depends on the kind of the sheet. For instance in the case where copies are formed by using two kinds of sheets generally employed as copying sheets, i.e., relatively thick sheet (SR) and a relatively thin sheet (L), the states of curling of the two sheets are as indicated in FIG. 7. This will be described in more detail. That is, experiments were carried out in which images having an image density of 10% were formed on the sheets, and for each of the sheets, the amount of depression of the roll was set to 6 mm and 10 mm to eliminate the curling. With the amount of depression of the roll set to 6 mm, it was possible to decrease the curling satisfactorily; however, in the case of the thin sheet, the curling was not so effectively decreased. That is, it seems that all kinds of sheets cannot be satisfactorily handled by the sheet straightening device.

In the case of an ordinary thick sheet, the copy will not greatly curled, and therefore in many cases it is unnecessary to give the curling eliminating operation to the copy. On the other hand, in the case where an image high in density is transferred onto a relatively thin sheet, the sheet is liable to be curled. Particularly in the case of a color copy, the latter is curled greatly because the image density is considerably high. Hence, the sheet straightening device of the invention can effectively handle a copy high in image density.

Therefore, the sheet straightening device of the invention may have means for adjusting the amount of depression of the depressing roll by inputting data on the kind of sheets loaded in the sheet supplying section through the control panel, or by using data on the density of an image formed on the photo-sensitive drum. However, if it is troublesome for the operator to input the data on the sheet with set buttons on the control panel, then a fundamental amount of depression of the depressing roll may be set, in advance, according to the kind of a recording sheet which is most frequently used in the electronic copying machine. Furthermore, in the case where the electronic copying machine is a color copying machine, the amount of depression of the depressing roll may be determined according to the amount of curling which occurs with an general color copy. In addition, a plurality of amounts of depression may be set in advance by taking into consideration the cases where the copying machine is operated in two modes, a monochromatic mode and a color mode, and the case where a thin sheet is manually inserted into the machine.

Figure 11:
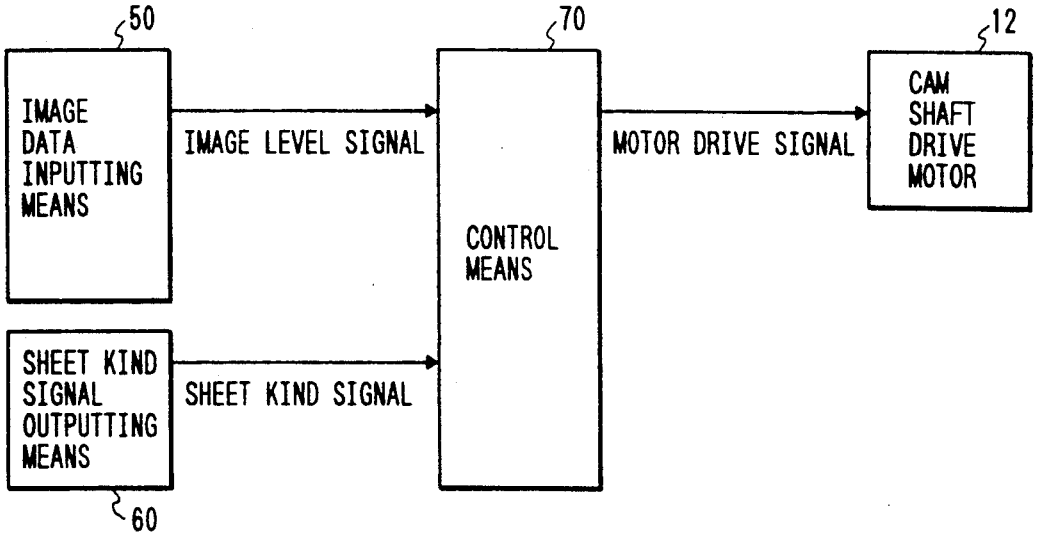
FIG. 11 is a block diagram showing a fundamental arrangement of a device for determining an amount of depression most suitable for elimination of the curling of a sheet.

The aforementioned control will be described in more detail. Its fundamental arrangement, as shown in FIG. 11, comprises: image data inputting means 50; sheet kind signal outputting means 60 for outputting a signal representing the kind of a recording sheet (hereinafter referred to as "a sheet kind signal", when applicable); control means 70 for determining a most suitable amount of depression of a depressing member is determined from an image signal and the sheet kind signal.

Figure 13:
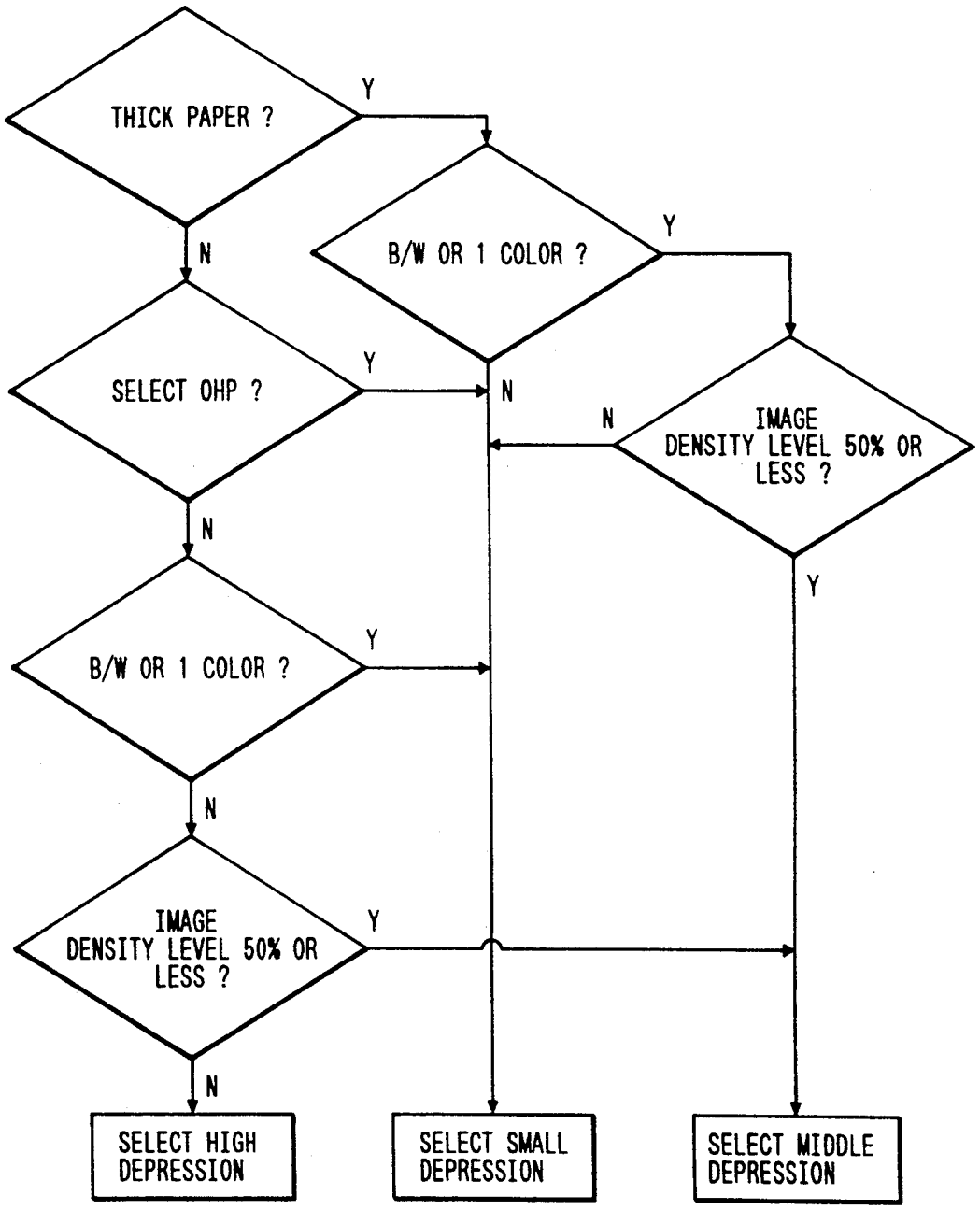
FIG. 13 is a flow chart for a description of the control in determination by the control means.

The image data inputting means is, for instance, an IIT (image input terminal) of a color copying machine, which scans an original image four times to provide an RGBK signal (where K=black) with the aid of a photo-electric converter such as an image sensor. The RGBK signal is converted into a CMYK signal when necessary, which is applied to an IOT (image output terminal). In the image data inputting means, the CMYK signal is subjected to determination; that is, it is determined whether the density of its output image is not more than 50% or whether it is more than 50%, and an image density level signal corresponding to the result of determination is applied to the control means 70. Furthermore, image data inputting means 50 applies an image color signal to the control means 70 which indicates that the output image is an monochromatic image using one of the four colors, cyan, magenta, yellow and black, or a multiple color image using more than one of the four colors. The sheet kind signal outputting means 60 may be such that a sensor or the like detects the kind of a sheet which is to be used for outputting an image, to provide a sheet kind signal, or it may be so designed as to electrically output the kind of a sheet which the operator has selected with the operation panel (or console panel) of the color copying machine. The control means 70 has a non-volatile memory, in which an LUT (look up table) as shown in FIG. 12 has been stored. Thus, in response to the image density level signal, the image color signal, and the sheet kind signal, the control means outputs a signal in accordance with a plurality of predetermined motor drive levels. The control in determination by the control means is as shown in a flow chart of FIG. 13. Each of the motor drive levels has been set in correlation with the amount of depression of the depressing member which are required for eliminating the curling of sheet the degree of which is estimated from the image density and color of an output image and from the kind of the sheet. Thus, the sheet straightening device of the invention applies a force of depression to a recording sheet which is most suitable for eliminating the curling of the sheet.

The provision of the sheet straightening device for color copies is essential due to the following reason: In the case of a color copy, the pictorial color is outputted by forming four color toner layers, C (cyan), M (magenta), Y (yellow) and K (black) toner layers on a transfer sheet one on another. Therefore, roughly stated, the pile height of toner particles on the transfer sheet is about four times larger than in the case of an ordinary monochromatic (black and white) copy. Hence, the region of the sheet where the toner layers are formed is greatly different in the degree of shrinkage from the region where not toner layers are formed.

APPLICATION TO COPYING MACHINE

Figure 8:
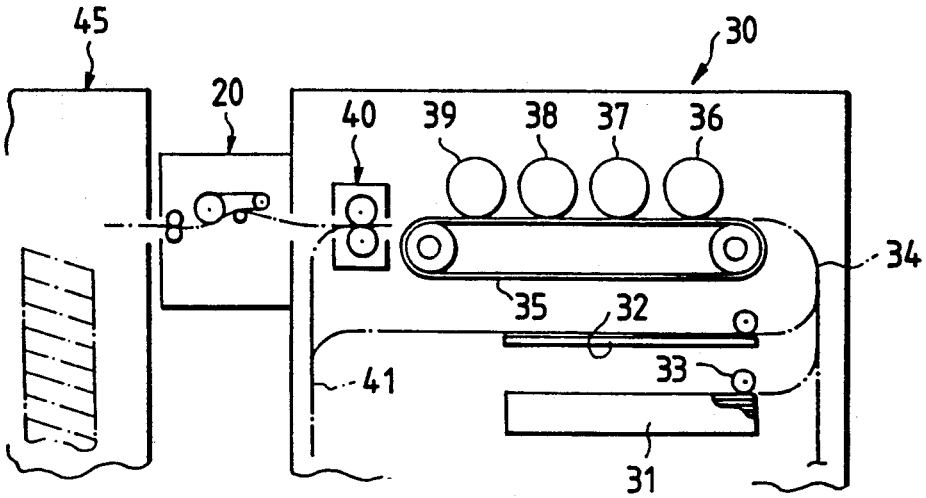
FIG. 8 is an explanatory diagram showing the sheet straightening device arranged in a color copying machine.

As shown in FIG. 8, the sheet straightening device thus constructed may be arranged between a copying machine 30 and an after-treatment device such as a sorter so as to eliminate the curling of a copy coming out of the copying machine. In FIG. 8, the copying machine 30 is a color copying machine. Recording sheets stacked, for instance, on a sheet tray 31 are supplied through a sheet supplying path 34 to a sheet conveying belt 35, and electrostatically retained on the latter 35. A plurality of developing units 36 through 39 are arranged along the conveying belt 35 to transfer color toner images onto the sheet thus retained on the conveying belt 35. The color toner images thus transferred are fixed by a fixing unit 40. Thus, a color copy has been formed. The copying machine 30 has means for forming images on both sides of a sheet. That is, with the means, a sheet on one side of which an image has been formed is delivered through a sheet turn over path 41 into an intermediate tray 32, and then conveyed from the intermediate tray 32 so that an image is formed on the other side thereof. Thus, images have been formed on both sides of the sheet. In this embodiment, the sheet straightening device may be the one shown in FIG. 1. Therefore, the components forming the sheet straightening device are designated by the same reference numerals or characters as those in FIG. 1.

Figure 9:
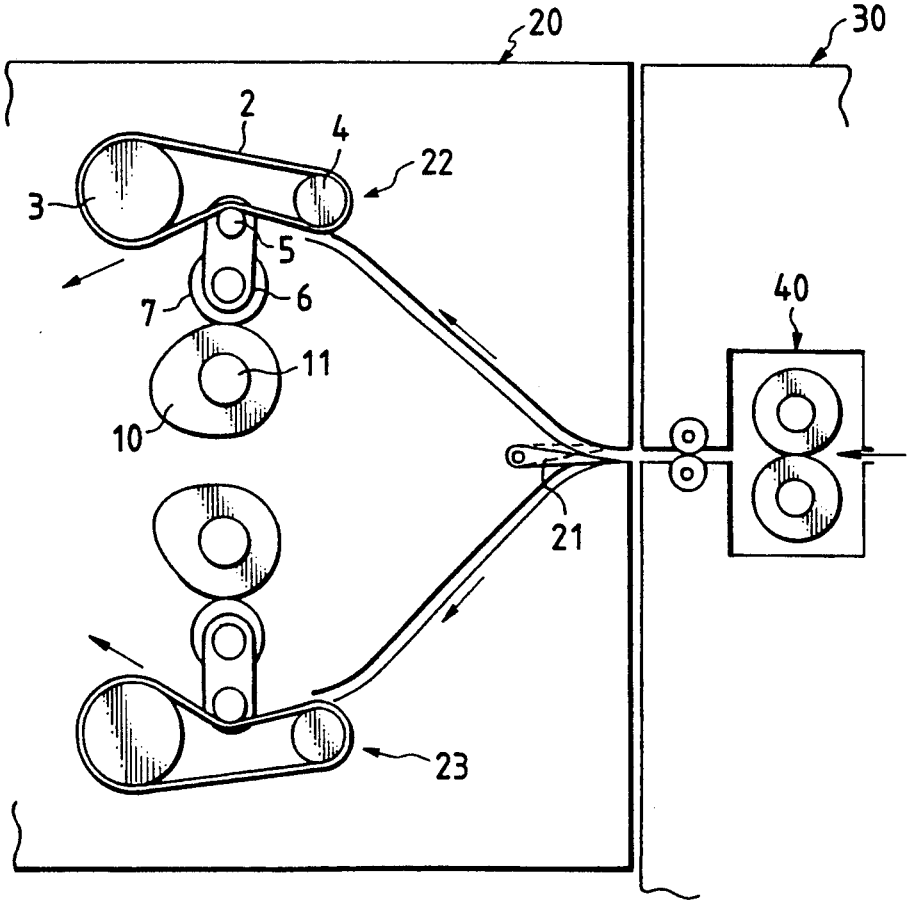
FIG. 9 is an explanatory diagram showing the arrangement of one example of the sheet straightening device.
Figure 10:
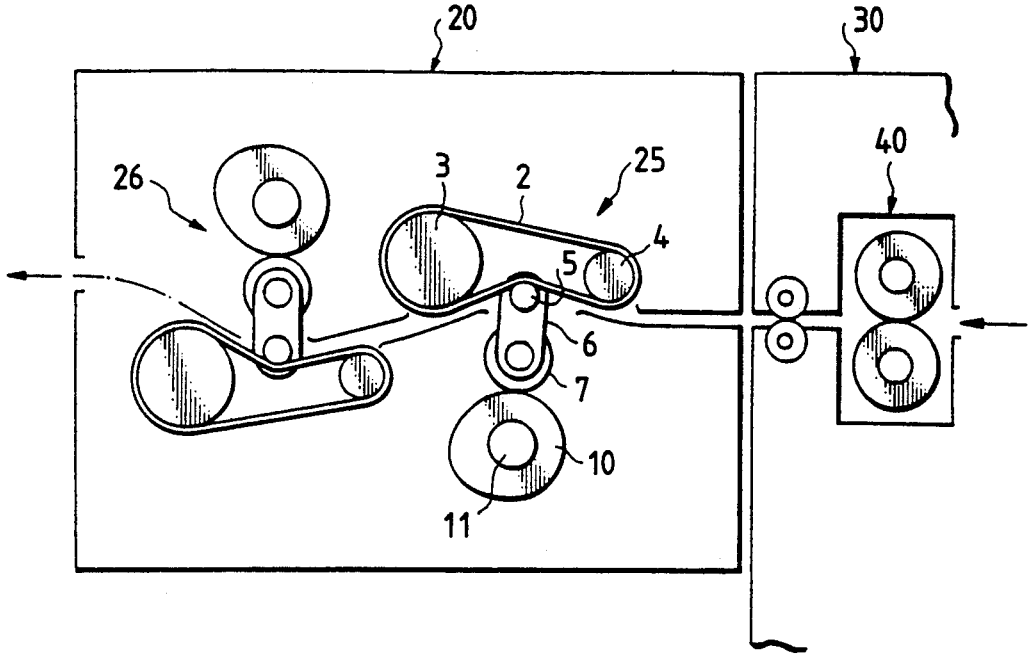
FIG. 10 is an explanatory diagram showing the arrangement of another example of the sheet straightening device.

As shown in FIG. 8, a sheet straightening device 20 is arranged between the copy discharging section of the copying machine 30 and the sorter 45, so that when a copy is delivered through the sheet straightening device 20 into the sorter 45, the sheet straightening device operates to decrease the degree of curling of the copy. For this purpose, as shown in FIG. 9 or 10, the sheet straightening device 20 may be made up of two sheet straightening devices. In the case of FIG. 9, the sheet straightening device 20 comprises two sheet straightening devices 22 and 23 which are arranged in parallel, a sheet path selecting pawl 21 is provided for two sheet paths along which sheets are led to the two sheet straightening devices, so that a sheet is delivered to one of the two sheet straightening deivces according to, for instance, the densities of images formed on both sides of the sheet. With the sheet straightening device, the curled sheet can be suitably straightened. Thus, in the case where a curled copy on both side of which images are formed is sent to one of the two sheet straightening devices according the difference in density between the images, the degree of correction of the curling can be adjusted according to the data of the copy.

In the sheet straightening device 20 shown in FIG. 10, the two sheet straightening devices 25 and 26 are arranged in serials which are opposite in sheet straightening direction to each other. According to the direction of curling of a sheet, the sheet straightening force of one of the sheet straightening devices is made greater than that of the other. In the case of FIG. 10, image data provided by the copying machine 30 are applied to the sheet straightening device 20, so that a relatively high sheet straightening action is given to the side of the sheet on which the image density is higher and the sheet is therefore liable to be curled, and a relatively low sheet straightening action is given to the other side.

As was described above, in the sheet straightening device of the invention, the depressing roll is pushed against the endless belt to bend the latter, and the degree of bending the endless belt with the depressing roll is adjustable. Hence, the curled sheet can be straightened according to the degree of curling of. Furthermore, the sheet straightening device of the invention can be miniaturized. Therefore, it can be applied to an electronic copying machine relatively small in size. In addition, it can be readily set between the fixing unit and the sheet discharging rollers in an electronic copying machine which is popularly. With the device, the copy conveying operation is carried out according to a given mode in which a copy is discharged directly into the copy discharging tray, or a mode in which a copy having an image on its one side is conveyed for the formation of an image on the other side. Furthermore, the device of the invention can handle an ordinary black and white copy as well as a color copy, and can be operated according to the thickness and paper quality of a sheet.

What is claimed is:

1. A sheet straightening device for decreasing curl of a sheet caused when a toner image is fixed thereon, said device comprising:

an endless belt;

endless belt driving means for driving said endless belt in a predetermined direction;

depressing means for contacting a surface of said endless belt to form a first nipping portion through which said sheet is passed;

force varying means for changing a depressing force applied to the surface of said endless belt contacted by said depressing means;

means for providing information corresponding to sheet curling characteristics of at least one of said sheet and the toner image; and control means for controlling said depressing force varying means in accordance with provided information corresponding to sheet curling characteristics.

2. A sheet straightening device as claimed in claim 1, wherein said means for providing information includes:

means for detecting an image level of a toner image formed on said sheet.

3. A sheet straightening device as claimed in claim 1, wherein said means for providing information includes:

means for detecting color data of a toner image formed on said sheet.

4. A sheet straightening device as claimed in claim 1, wherein said means for providing information includes:

means for detecting sheet kind.

5. A sheet straightening device as claimed in claim 4, wherein said sheet kind detecting means includes:

means for detecting sheet material.

6. A sheet straightening device as claimed in claim 4, wherein said sheet kind detecting means includes:

means for detecting sheet thickness.

7. A sheet straightening device as claimed in claim 1, further comprising:

fixing means for providing a second nipping region for fixing a toner image, said fixing means including a pair of heating roller members which are engaged with each other, and wherein said second nipping region is arranged in series with said first nipping region.

8. A sheet straightening device for decreasing curl of a sheet caused when a toner image is fixed on the sheet, said device comprising:

an endless belt;

endless belt driving means for driving said endless belt in a predetermined direction, said endless belt driving means provided in contact with an inner surface of said endless belt;

depressing means for depressing said endless belt by contacting an outer surface of said endless belt to form a first nipping portion through which said sheet is passed; and depression force varying means for changing a force of depression of said depressing means, said force being applied to said outer surface of said endless belt, said depression force varying means comprising:

a shaft member brought in contract with said endless belts;

a link member fixed in position relative to said shaft member;

a roller member rotatably coupled to said link member;

a cam mechanism engaged with said roller member;

cam mechanism driving means for driving said cam mechanism; and drive control means for controlling said cam mechanism driving means.

9. A sheet straightening device as claimed in claim 8, wherein said cam mechanism has a plurality of stop positions.

10. A sheet straightening device as claimed in claim 9, wherein said cam mechanism comprises:

a cam shaft;

a cam disk fixedly mounted on said cam shaft;

an indexing disk fixedly mounted on said cam shaft, said indexing disk having:

a plurality of pawls;

a locking member adapted to engage with said pawls; and operating means for operating said locking member.

11. A sheet straightening device for decreasing curl of a sheet caused when a toner image is fixed thereon, said device comprising:

a first endless belt;

a second endless belt;

first depressing means for contacting an outer surface of said first endless belt to form a first nipping portion through which said sheet is passed;

second depressing means for contacting an outer surface of said second endless belt to form a second nipping portion through which said sheet is passed;

depression force varying means for changing at least one depressing force applied to said surfaces of said first and second endless belts contacted by said first and second depressing means, respectively, detecting means for detecting characteristics of said sheet; and control means for controlling said depressing force varying means in accordance with sheet characteristics detected by said detecting means.

12. A sheet straightening device as claimed in claim 11, wherein said detecting means includes:

means for detecting an image level of a toner image formed on said sheet.

13. A sheet straightening device as claimed in claim 11, wherein said detecting means includes:

means for detecting toner image color data of a toner image formed on said sheet.

14. A sheet straightening device as claimed in claim 11, wherein said detecting means contains:

means for detecting a sheet kind of said sheet.

15. A sheet straightening device as claimed in claim 14, wherein said sheet kind detecting means includes:

means for detecting a material of said sheet.

16. A sheet straightening device as claimed in claim 14, wherein said sheet kind detecting means includes:

means for detecting a thickness of said sheet.

17. A sheet straightening device as claimed in claim 11, wherein said depression force varying means independently changes depressing force exerted by said first depressing means and second depressing means.

18. A sheet straightening device for decreasing curl of a sheet caused when a toner image is fixed thereon, said device comprising:

an endless belt;

means for driving said endless belt in a predetermined direction;

depressing means for contacting a surface of said endless belt to form a first nipping portion through which said sheet is passed;

depressing force varying means for changing a depressing force applied to said surface of said endless belt contacted by said depressing means;

signal generating means for generating information signals corresponding to sheet curling characteristics of at least one of said sheet and the toner image; and control means for controlling said depressing force varying means in accordance with at least one signal generated by said signal generating means.

19. A sheet straightening device as claimed in claim 18, wherein said information signal generating means includes:

user interface means for inserting information relative to the characteristics of said sheet; and means for converting information inserted by said user interface means into said information signal.

20. A sheet straightening device as claimed in claim 18, wherein said information signal corresponds to a toner image color formed on said sheet.

21. A sheet straightening device as claimed in claim 18, wherein said information signal corresponds to a material of said sheet.

22. A sheet straightening device as claimed in claim 18, wherein said information signal corresponds to a thickness of said sheet.

* * * * *

UNITED STATES PATENT AND TRADEMARK OFFICE

CERTIFICATE OF CORRECTION

PATENT NO. : 5,287,157
DATED : February 15, 1994
INVENTOR(S) : Kazuhiko Miyazato, et al.

It is certified that error appears in the above-indentified patent and that said Letters Patent is hereby corrected as shown below:

On the title page, item [30]: Insert --Foreign Application Priority Data May 14, 1991 [JP] Japan .....3-138376--.

Claim 8, column 10, line 25, change "contract" to --contact--.

Signed and Sealed this
First Day of November, 1994

Bruce Lehman

BRUCE LEHMAN
*Commissioner of Patents and Trademarks*

*Attest:*

*Attesting Officer*